US010500467B2

(12) United States Patent
Watson

(10) Patent No.: US 10,500,467 B2
(45) Date of Patent: Dec. 10, 2019

(54) HAND WEARABLE VISUAL TRAINING AID DEVICE FOR GOLFING AND METHOD OF USE THEREOF

(71) Applicant: Edward Bates Watson, Dana Point, CA (US)

(72) Inventor: Edward Bates Watson, Dana Point, CA (US)

( * ) Notice: Subject to any disclaimer, the term of this patent is extended or adjusted under 35 U.S.C. 154(b) by 0 days.

(21) Appl. No.: 16/107,101

(22) Filed: Aug. 21, 2018

(65) Prior Publication Data

US 2018/0353826 A1 Dec. 13, 2018

Related U.S. Application Data

(63) Continuation-in-part of application No. 15/399,515, filed on Jan. 5, 2017, now Pat. No. 10,173,121.

(51) Int. Cl.

| | |
|---|---|
| ***A63B 69/36*** | (2006.01) |
| ***A63B 71/06*** | (2006.01) |
| ***A63B 1/00*** | (2006.01) |
| ***A63B 71/14*** | (2006.01) |

(52) U.S. Cl.

CPC ..... *A63B 69/3608* (2013.01); *A63B 1/00* (2013.01); *A63B 71/0622* (2013.01); *A63B 71/146* (2013.01); *A63B 2071/0663* (2013.01); *A63B 2071/0694* (2013.01); *A63B 2207/02* (2013.01); *A63B 2210/50* (2013.01)

(58) Field of Classification Search

CPC ..... A63B 69/3608; A63B 71/0622; A63B 71/146; A63B 2207/02; A63B 2071/0694; A63B 2210/50; A63B 2071/0663

See application file for complete search history.

(56) References Cited

U.S. PATENT DOCUMENTS 3,847,110 A * 11/1974 Inoue ..... A63B 71/0672 116/223

2012/0071255 A1* 3/2012 Lidenberg ..... A63B 69/3608 473/205

* cited by examiner

*Primary Examiner* — Jeffrey S Vanderveen

(57) ABSTRACT

A hand wearable visual training aid device worn by the hand of a golfer and for use with a golf club having a clubface is presented and described herein. The hand wearable visual training aid device includes a glove or hand strap and a multisided guide and reference unit mounted to the glove or hand strap. The multisided guide and reference unit mounted on the hand wearable visual training aid device is used to visually assist and guide the wrist of the golfer which, in turn, promotes clubface alignment prior to impact, providing a better strike and center hit for achieving greater accuracy and distance on the golf ball.

18 Claims, 18 Drawing Sheets

HAND WEARABLE VISUAL TRAINING AID DEVICE FOR GOLFING AND METHOD OF USE THEREOF

RELATED APPLICATIONS

This application claims the benefit of priority of U.S. application Ser. No. filed Ser. No. 15/399,515, filed Jan. 5, 2017, which is herein incorporated by reference to the present application.

FIELD OF THE INVENTION

The present invention relates to a golf training aid device. In particular, the present invention relates to a hand wearable visual training aid device including a multisided guide and reference unit for providing a visual feedback of a grip type of a golfer.

BACKGROUND

Several conventional golf training aid devices exist to help a golfer improve their golf swing, thereby improving the stability and accuracy of the golfer's swing. Some of these training aid devices are designed to be attached to club grips of golf clubs, while other devices may be worn by the golfer. For example, golf training aid devices may include motion restricting or limiting devices that guide and limit the range of the hands of the golfer to be in the proper swing position. Other devices may include golf visual training devices that are attached to the golf club, providing a visual reference guide for setting the proper clubface orientation of the golf club prior to impact.

Although many golf training devices aid in improving posture, swing and golf club positioning, other training aid devices may be beneficial for improving consistency and power of the golfer's swing, resulting in better accuracy and range.

SUMMARY

It is an advantage of the present invention to provide a a hand wearable visual training aid device for use with a golf club having a clubface, the hand wearable visual training aid device includes a hand supporting body having a top side member and a palm side member opposite to the top side member; a coupling and supporting member having a top end portion and a bottom end portion, the bottom end portion is coupled to the top side member of the hand supporting body; and a multisided guide and reference unit coupled to the top end portion of the coupling and supporting member, the multisided guide and reference unit provides a visual feedback representation of a golf grip type to guide the clubface of the golf club.

It is another advantage of the present invention to provide a method of determining a golf grip type of a golfer using a hand wearable visual training aid device for use with a golf club having a handle and a clubface, the method including attaching the hand wearable visual training aid device to the left hand or right hand of the golfer, the hand wearable visual training aid device includes a multisided guide and reference unit having at least six faces and a bottom side portion; adjusting the multisided guide and reference unit so that the bottom side portion of the multisided guide and reference unit runs approximately parallel to the wrist of the hand of the golfer on which the multisided guide and reference unit is attached; gripping the handle of the golf club by the golfer at address position; and visually determining the golf grip type based on a number of labels visible on the multisided guide and reference unit, where a single visible label indicate a weak grip, two visible labels indicate a neutral grip, and three visible labels indicate a strong grip.

In another embodiment, the hand supporting body is a glove or a hand strap.

In yet another embodiment, the multisided guide and reference unit provides the visual feedback representation to guide the hand of the golfer.

It still yet another embodiment, the multisided guide and reference unit is a multisided 3-dimensional structure having at least six faces, including a first side face, a second side face, a third side face, a fourth side face, a top face, and a bottom face.

In one aspect, a first reference marker label is applied to the first side face, a second reference marker label is applied to the second side face, and a third reference marker label is applied to the third side face.

In yet another aspect, the first reference marker label has a first label attribute, the second reference marker label has a second label attribute different from the first label attribute, and the third reference marker label has a third label attribute different from the first label attribute and the second label attribute.

In still yet another aspect, the second label attribute, and the third label attribute include a plurality of different label colors, a plurality of different label shapes, a plurality of different label shadings, or a combination thereof.

In another aspect, a fastener is attached to the bottom face of the multisided guide and reference unit.

In some embodiments, the coupling and supporting member includes a support bar and a flange coupled to the support bar.

In another aspect, the multisided guide and reference unit is detachable from the coupling and supporting member.

In yet another aspect, the multisided guide and reference unit and the coupling and supporting member form a single unitary structure.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, one or more elements may have the same reference numeral in different figures indicating previously described elements.

DETAILED DESCRIPTION

Properly orientating and positioning a golf club can be challenging and difficult for many golfers. In a typical golf club design, the main parts of the golf club include a grip, a shaft, and a head. The head of the golf club has two sides known as a clubface and a back. In practice, the ideal is to get the clubface to a golf ball perpendicular at impact. With respect to the clubface, it may be difficult to achieve a proper center-face impact of the clubface due to improper golf club handling techniques.

Figure 1:
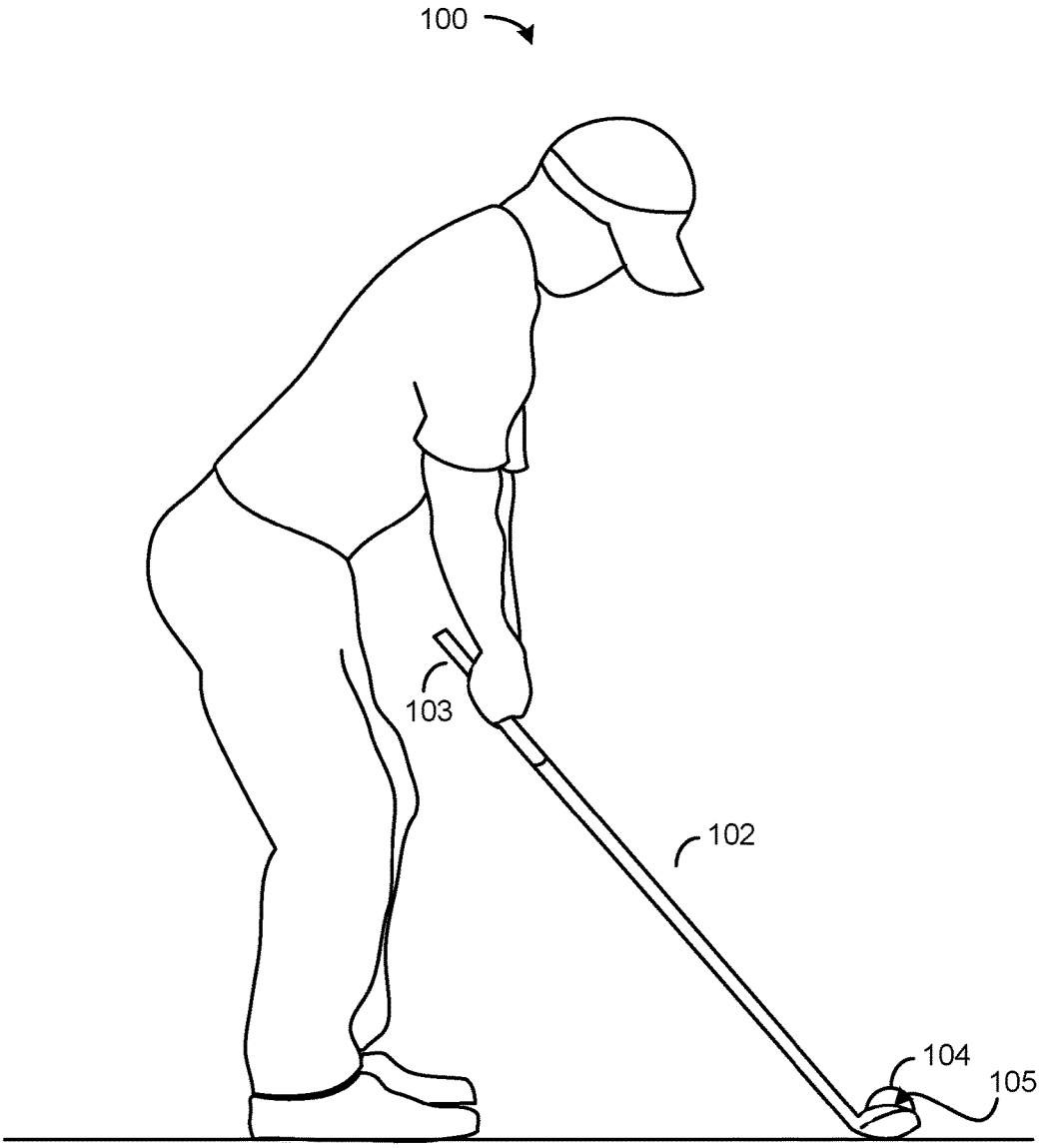
FIG. 1 illustrates a posture and alignment of a golfer gripping a golf club at address position.

FIG. 1 illustrates a golfer 100 with a golf club 102 at address or starting position. At address position, the clubface of the golf club 102 is positioned on an imaginary target line. A golf ball 104 is placed along the imaginary target line so that the clubface 105 of the golf club 102 is substantially perpendicular to the golf ball prior to impact. In practice, the top of the grip 103 of the golf club points directly at the golfer 102 while the clubface points directly at the target line. As previously mentioned, improper and poor club handling techniques can and often lead to inconsistent and ineffective golf swings at impact. For example, a slight shift in rotation of the golf club 102 can adversely affect the clubface alignment at impact, resulting in less distance and accuracy. To overcome this problem, a visual reference device may be used to aid and facilitate consistent wrist alignment techniques of the golfer prior to impact.

Figure 2A:
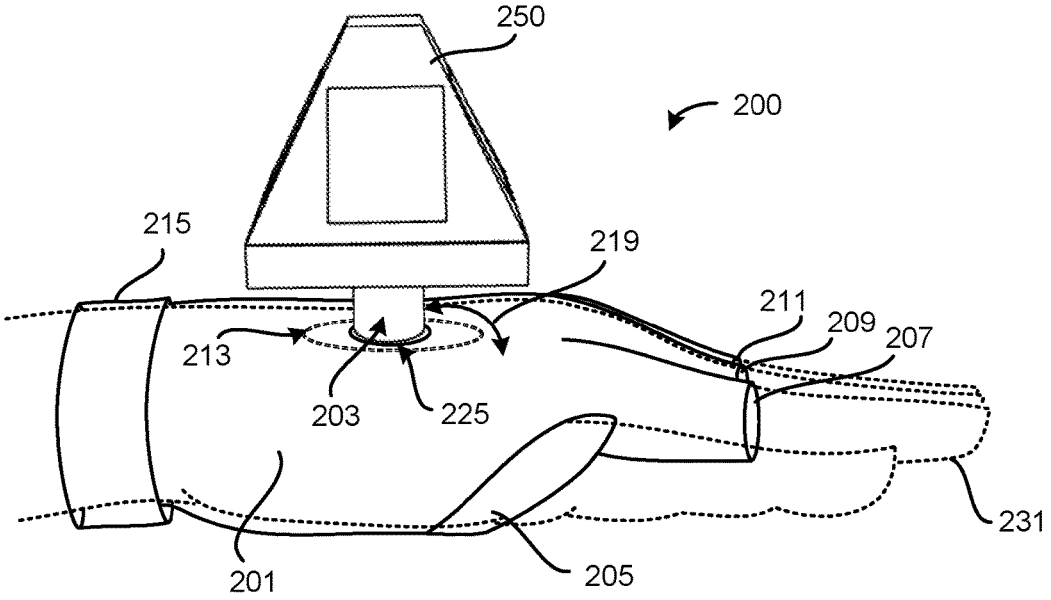
FIG. 2A and FIG. 2B illustrate a first side view (pinky side view) and a second side view (thumb side view), respectively, of a glove type hand wearable visual training aid device, in accordance with an embodiment.
Figure 2B:
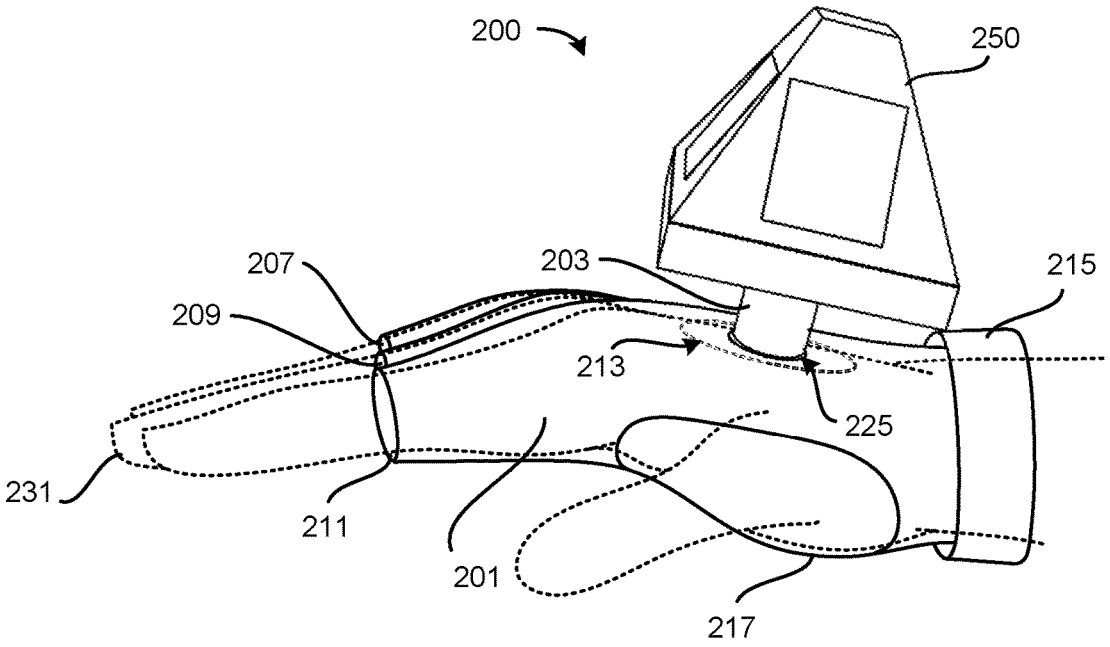

FIG. 2A and FIG. 2B illustrate a first side view (pinky side view) and a second side view (thumb side view), respectively, of a glove type hand wearable visual training aid device 200, in accordance with an embodiment. The glove type hand wearable visual training aid device 200 in this embodiment may include a glove 201, an optional wrist support strap 215 attached to the wrist end of the glove 201, a coupling and supporting member 203 having a top end portion and a bottom end portion, where the top end portion of the coupling and supporting member 203 is connected to a multisided guide and reference unit 250, and the bottom end portion of the coupling and supporting member 203 is connected to a top portion of the glove 201. The bottom end of the coupling and supporting member 203 may include a flange (not shown) that secures the coupling and supporting member 203 to the glove 201 and provides support when the coupling and supporting member 203 is inserted through an opening 225 (for example, a hole) in the glove 201 which is positioned near the center of the top portion of the glove 201. In one example, threads and cross-stitching 213 may be used to secure and fasten the coupling and supporting member 203 to the glove 201, though other fastening techniques may be employed.

When worn on the hand 231 of the golfer 100, the multisided guide and reference unit 250 is positioned near the center-middle portion of the backside of the hand 231, between the wrist and knuckle of the middle finger. In practice, the hand wearable visual training aid device 200 may be worn with or without a standard golf glove. To accommodate the standard golf glove, the glove 201 may be slightly oversized to receive and fit into the standard golf glove. To further enhance the fit, the glove 201 may be configured to have multiple openings (pinky slot 205, index slot 207, middle slot 209, ring finger slot 211, and thumb slot 217) to expose all fingers of the hand of the golfer, providing additional room and comfort. When mounted to the glove 201, the coupling and supporting member 203 is approximately perpendicular to the surface of the top of the glove 201 (see reference angle 219).

Figure 2C:
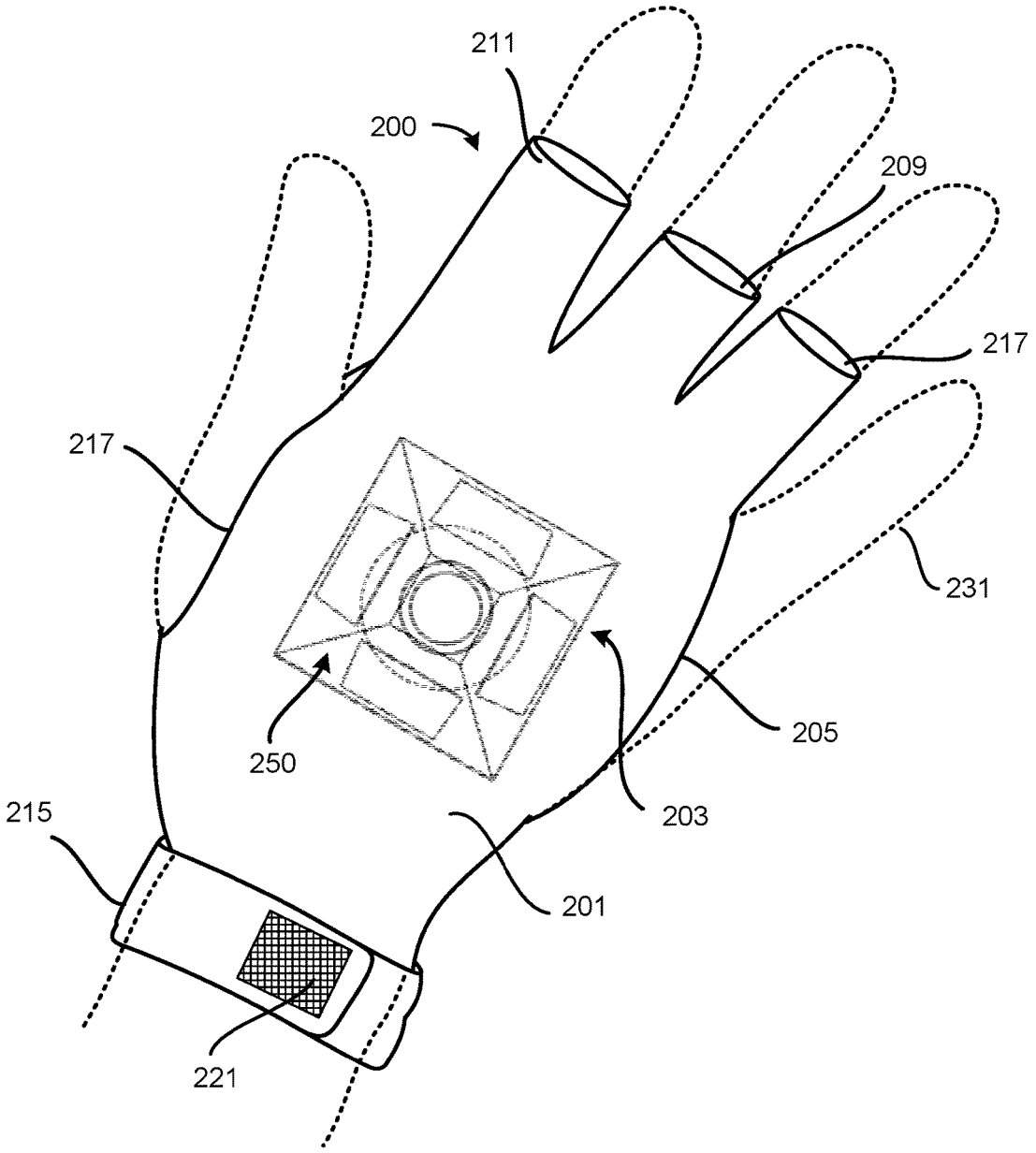
FIG. 2C and FIG. 2D illustrate a top side view and a palm side view, respectively, of the glove type hand wearable visual training aid device, in accordance with an embodiment.
Figure 2D:
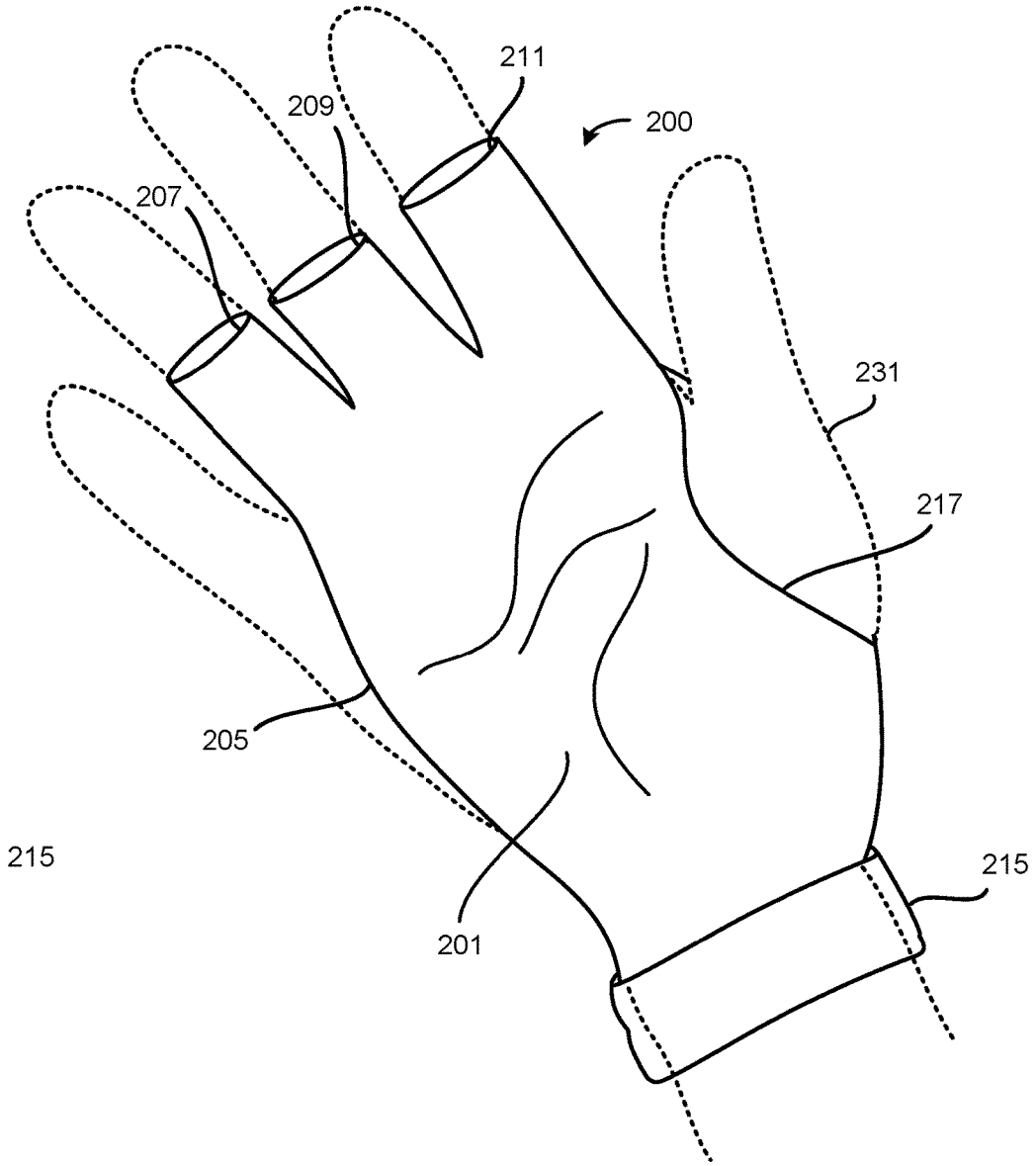

FIG. 2C and FIG. 2D illustrate a top side view and a palm side view, respectively, of the glove type hand wearable visual training aid device 200. As shown in FIG. 2C, the optional wrist support strap 215 may be adjustable, providing additional support, and firmly securing the glove 201 to the wrist of the golfer when worn by the golfer. A hook and loop fastener 221 may be used to attach each end of the wrist support strap 215, joining and securing each end of the wrist support strap as shown in the top side view of FIG. 2C.

For illustration purposes, the glove type hand wearable visual training aid device 200 shown in FIG. 2A through FIG. 2D is made to be worn on the right hand 231 of the golfer. For left-handed golfers, a left handed version of the glove type hand wearable visual training aid device 200 may be made using a mirrored configuration of the hand wearable visual training aid device 200 presented hereinabove.

Various materials and manufacturing techniques may be used to fabricate the glove type hand wearable visual training aid device 200. For example, some materials used to form the glove portion 201 may include leather, synthetic leather, cloth, knitted or felted wool, rubber, latex, neoprene, and metal. Fabrication techniques includes, for example, stitching and sewing techniques, 3D printing techniques, and other plastic injection molding techniques. Materials forming the coupling and supporting member 203 and the multisided guide and reference unit 250 may include, for example, rubber, latex, plastics, PVC, wood and metal. In practice, the hand wearable visual training aid device 200 provides many benefits to golfer. Some of these benefits include, for example, a wearable device having a thin, ergonomic, portable, conforming, light-weight, and adjustable design.

Figure 3A:
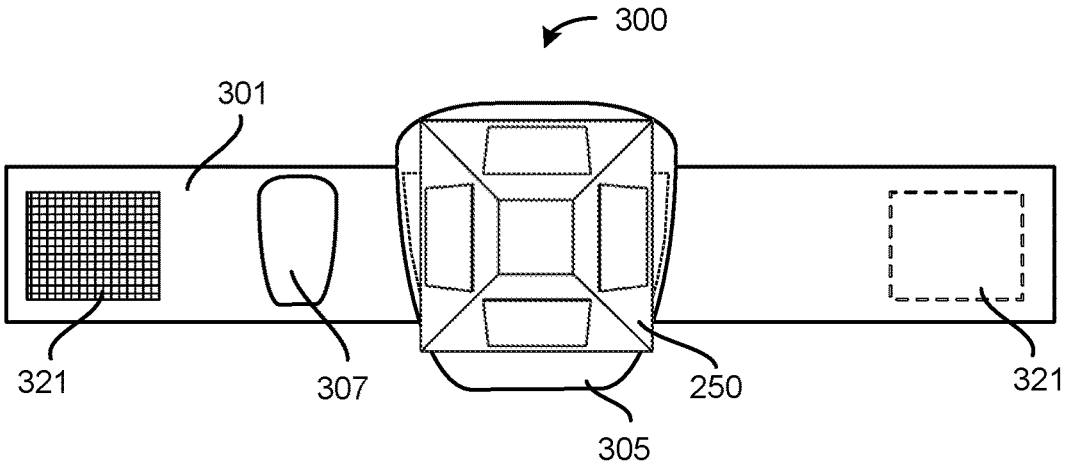
FIG. 3A and FIG. 3B illustrate a top view (topside) and bottom view (palm side), respectively, of a strap type hand wearable visual training aid device, in accordance with an embodiment.
Figure 3B:
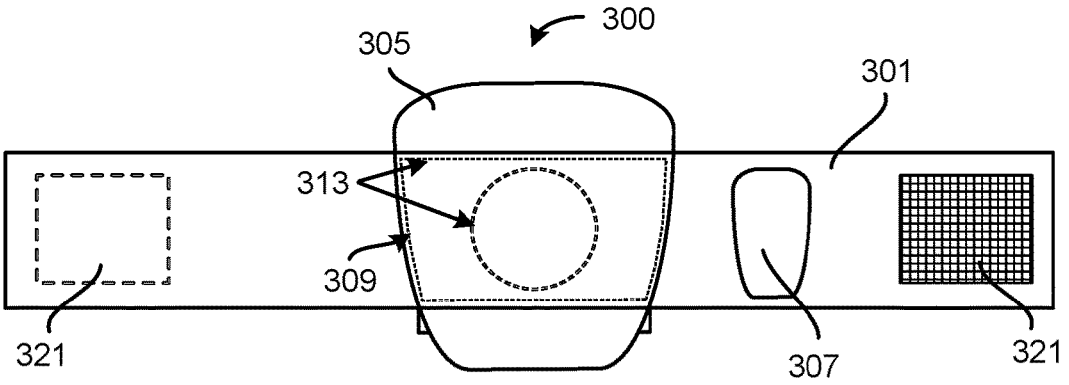

FIG. 3A and FIG. 3B illustrate a top view (topside) and bottom view (palm side), respectively, of a strap type hand wearable visual training aid device 300, according to another embodiment. The strap type hand wearable visual training aid device 300 in this embodiment includes a hand strap 301, a back hand support pad 305 centrally positioned and attached to the hand strap 301, a coupling and supporting member 203 (as presented in the previous embodiment) having a bottom end portion connected to a top member of the back hand support pad 305 of the hand strap 301 and positioned near a center middle portion of the back hand support pad 305, and a multisided guide and reference unit 250 (also previous presented) coupled to a top end portion of the coupling and supporting member 203. The strap type hand wearable visual training aid device 300 may also include an optional thumb insert slot 307 to accommodate the thumb of the golfer, providing a comfortable and conforming fit to the hand of the golfer. The optional thumb insert slot 307 may be formed on the left side of the back hand support pad 305 for a right-handed configuration or formed on the right side of the back hand support pad 305 for a left-handed configuration. As shown in FIG. 3A-FIG. 3B, the hand strap 301 may be adjustable, providing additional support, and firmly securing to the wrist of the golfer when worn by the golfer. A hook and loop fastener 321 or any other types of strap fasteners such as hooks, clasps, and buttons may be used to attach each end of the hand strap 301, joining each end of the hand strap 301 as shown in FIG. 3A-FIG. 3B. In one implementation, threading and cross-stitching 313 may be employed to secure and fasten the back hand support pad 305 to the hand strap 301, though other fastening techniques may be employed.

Figure 3C:
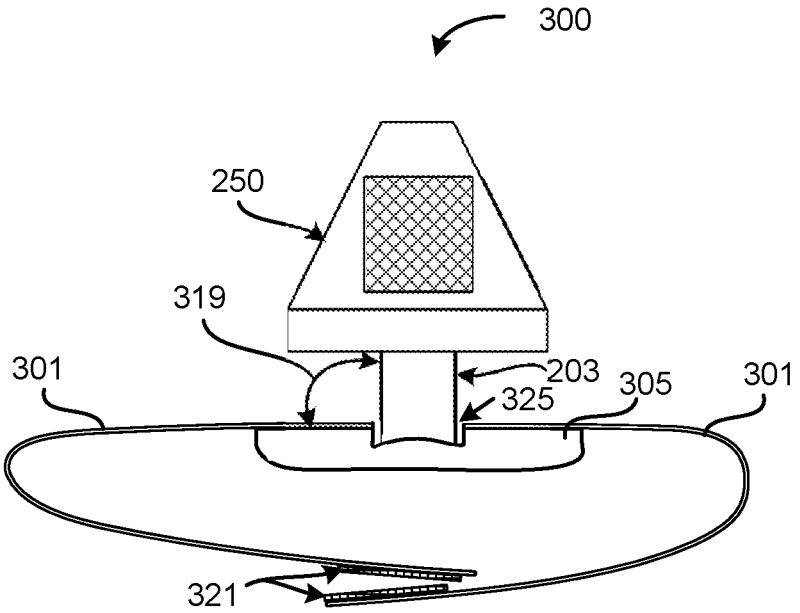
FIG. 3C illustrates a side view of the strap type hand wearable visual training aid device, in accordance with an embodiment.

FIG. 3C illustrates a side view of the strap type hand wearable visual training aid device 300. As shown in FIG. 3C, the coupling and supporting member 203 is inserted through an opening 325 (for example, a hole) formed in the hand strap 301 and back hand support pad 305, and substantially positioned near the center of the back hand support pad 305. The shape of the back hand support pad 305 may be configured to match the profile, shape, and contour of the hand 231 for an ergonomic and comfortable fit. When mounted to the hand strap 301, the coupling and supporting member 203 is approximately perpendicular to the surface of the top of the back hand support pad 305 (see reference angle 319).

Figure 4:
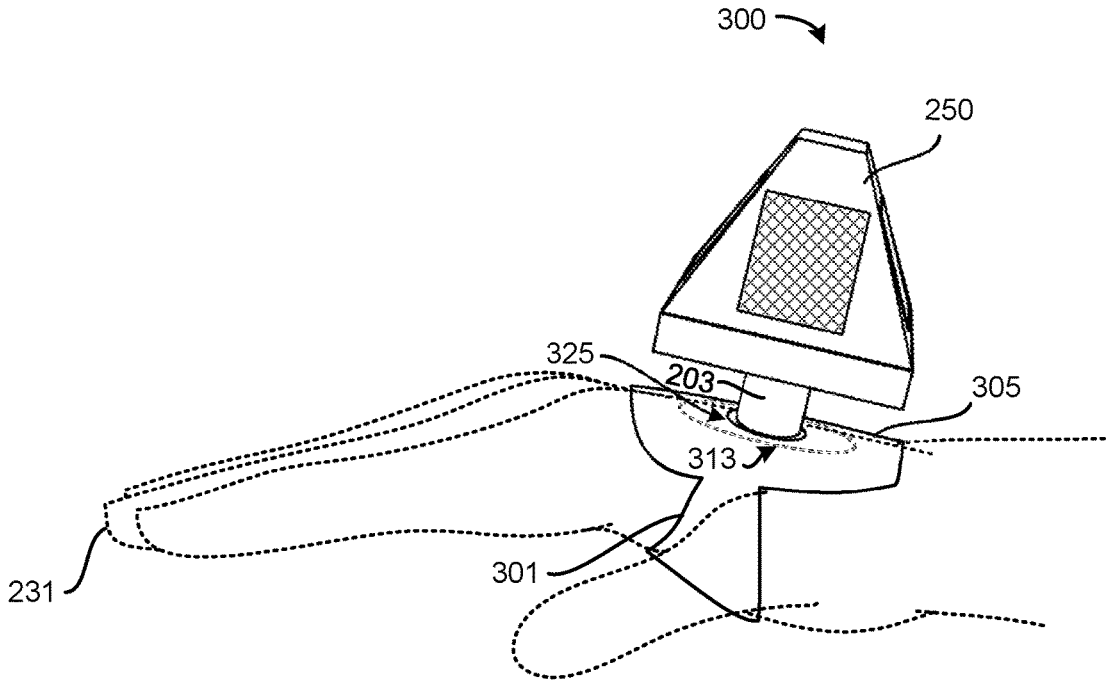
FIG. 4 illustrates a side view of the strap type hand wearable visual training aid device applied to the right hand of the golfer, in accordance with an embodiment.
Figure 5A:
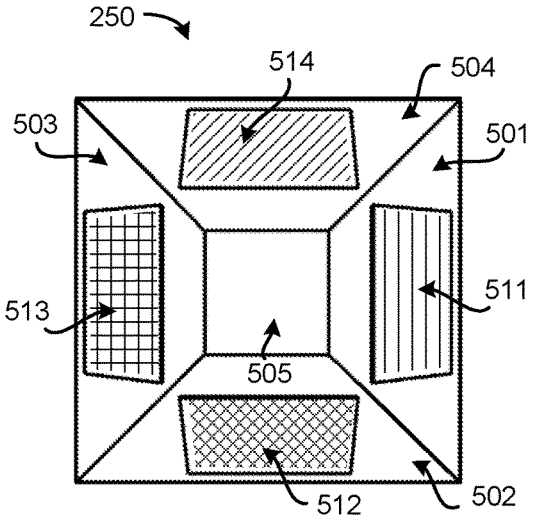
FIG. 5A-FIG. 5D illustrate several isolated views of the multisided guide and reference unit of the hand wearable visual training aid device strapped to the hand of the golfer, including a top view (FIG. 5A), a side view (FIG. 5B), a bottom view (FIG. 5C), and a side perspective view (FIG. 5D), in accordance with an embodiment.
Figure 5B:
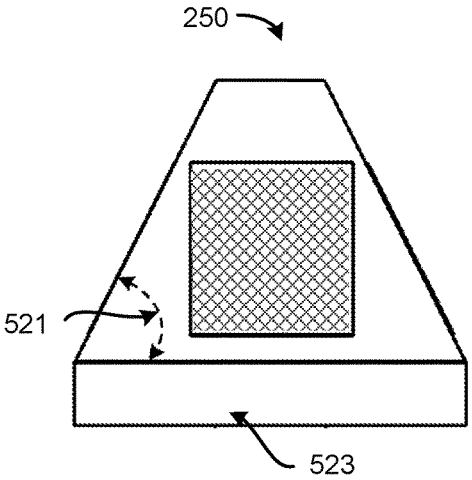
Figure 5C:
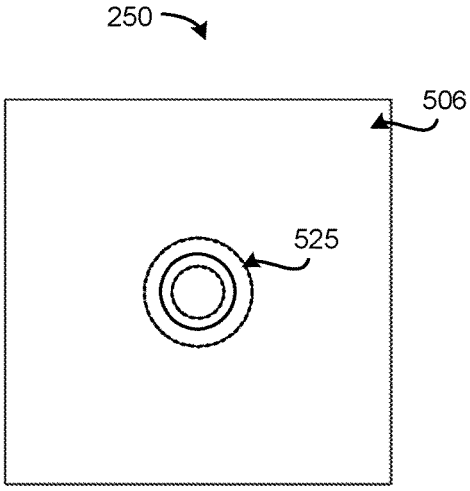
Figure 5D:
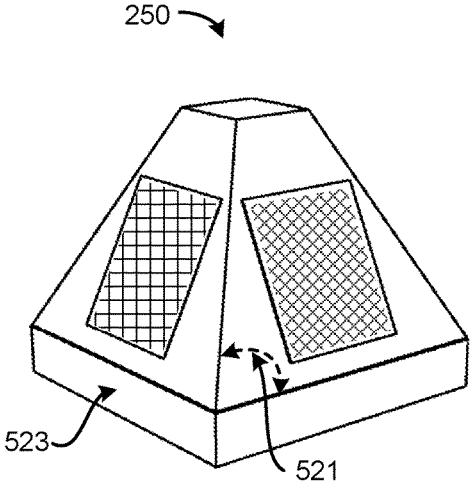

FIG. 4 illustrates a side view of the strap type hand wearable visual training aid device 300 applied to the right hand 231 of the golfer 100. In operation, the hand strap 301 is made to wrap around the palm of the hand 231 while the back hand support pad 305 rests on a flat portion of the backside of the hand 231, allowing the multisided guide and reference unit 250 to rest squarely and firmly on the backside of the hand 231. When worn on the hand of the golfer 100, the multisided guide and reference unit 250 is generally positioned between the wrist and knuckle of the middle finger and centered to the backside of the hand 231 so that the multisided guide and reference unit 250 is clearly visible and in the line of site of the golfer when gripping the golf club. As viewed from above, at least one side of the multisided guide and reference unit 250 runs approximately parallel to the wrist of the hand of the golfer. In practice, the strap type hand wearable visual training aid device 300 may be worn with or without a standard golf glove and may be configure to fit on either the left hand or right hand of the golfer 100. Various materials and manufacturing techniques may be used to fabricate the strap type hand wearable visual training aid device 300. For example, some materials used to form the strap portion 301 may include leather, synthetic leather, cloth, knitted or felted wool, rubber, latex, neoprene, and metal. Fabrication techniques includes, for example, stitching and sewing techniques, 3D printing techniques, and other plastic injection molding techniques. In practice, the strap type hand wearable visual training aid device 300 provides many benefits to golfer 100. Some of these benefits include, for example, a wearable device having a thin, ergonomic, portable, conforming, light-weight, and adjustable design.

FIG. 5A-FIG. 5D illustrate several isolated views of the multisided guide and reference unit 250 of the hand wearable visual training aid device (200 or 300) strapped to the hand of the golfer, including a top view (FIG. 5A), a side view (FIG. 5B), a bottom view (FIG. 5C), and a side perspective view (FIG. 5D) in accordance with an embodiment. The multisided guide and reference unit 250 is generally a multisided 3-dimensional structure having at least 6 faces (first face 501, second face 502, third face 503, fourth face 504, top face 505 and bottom face 506). Reference marker labels of different label types may be applied to at least 3 faces of the multisided guide and reference unit 250. For example, a first label type 511 may be applied to the first face 501, a second label type 512 may be applied to the second face 502, a third label type 513 may be applied to the third face 501, and an optional fourth label type 514 may be applied to the fourth face 504. Each label type is configured to be different from each other and may include different colors, shapes, hatchings/shadings, alpha-numeric characters, or a combination thereof as shown in Table 1 below.

TABLE 1

| Label Type | First Label Type 511 | Second Label Type 512 | Third Label Type 513 | Fourth Label Type 514 (Optional) |
|---|---|---|---|---|
| Color | Blue | Red | Green | Yellow |
| Shape | Circle | Square | Triangle | Oval |
| Hatching | Parallel | Crosshatching | Basket | Tick |
| Alpha-Numeric | A, 1 | B, 2 | C, 3 | D, 4 |

In practice, the colors, shapes, hatchings/shadings, alpha-numeric characters applied to the multisided guide and reference unit 250 are preferably of visually distinct attributes when viewed at arm's length. For example, if labels of various colors are applied, then the attribute of bright colors such as yellow, red, and orange would provide the golfer visually distinct reference between the different labels. Other variation of colors may be applied to enhance the visually distinct attributes of each label such as, for example, fluorescent colors.

The multisided guide and reference unit 250 is generally tapered in shape with the top face 505 having a rectangular shape that is smaller in size than a rectangular shape of the bottom face 506, forming an acute angle 521 between each side face (501-504) and a portion near the bottom face 506. A bottom side portion 523 may be used as a placement guide to adjust the multisided guide and reference unit 250 to the hand so that is runs approximately parallel to the wrist of the hand of the golfer. In one implementation, the bottom face 506 may include a threaded bolt or nut fastener 525 that attaches to a corresponding threaded fastener on the coupling and supporting member 203, allowing the multisided guide and reference unit 250 to be detachable from the coupling and supporting member 203. In another implementation, the multisided guide and reference unit 250 and the coupling and supporting member 203 may be molded as a single unitary structure.

In practice, the different reference marker labels (511-514) on the multisided guide and reference unit 250 provide reference markers to visually assist, guide and provide visual feedback of various grip positions to the golfer 100 which, in turn, may promote clubface alignment prior to impact, providing a better strike and center hit for achieving greater accuracy and distance on the golf ball.

Figure 6A:
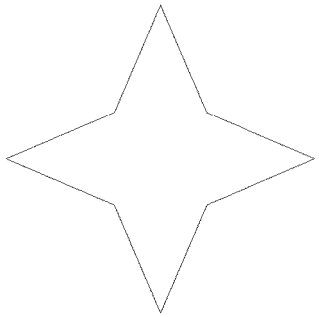
FIG. 6A-FIG. 6E illustrate other shapes and configurations of reference marker labels that may be applied to each side of the multisided guide and reference unit, in accordance with an embodiment.
Figure 6B:
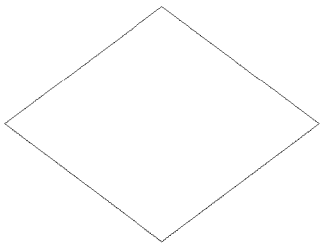
Figure 6C:
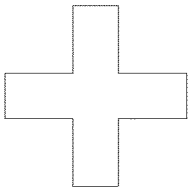
Figure 6D:
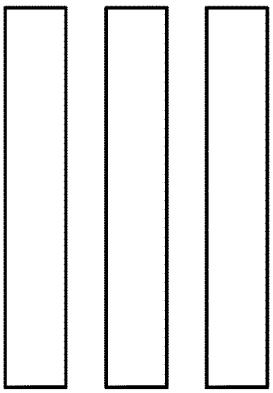
Figure 6E:
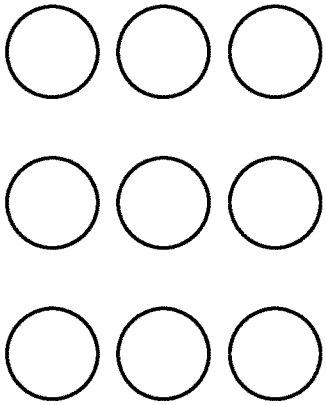

FIG. 6A-FIG. 6E illustrate other shapes and configurations of reference marker labels that may be applied to each side of the multisided guide and reference unit 250, in accordance with an embodiment. In one example, the reference marker labels may include other shapes such as stars (FIG. 6A), diamonds (FIG. 6B), or plus-signs (FIG. 6C). In another example, the reference marker labels may include other configuration of shapes such as multiple stripes (FIG. 6D) and an array of circles (FIG. 6E). The examples of reference marker labels provided herein are just a few examples which are not intended to limit the scope of other reference marker label types that may be applied to the multisided guide and reference unit 250 so long as the label provides a distinct pattern, color or shape applied on each of the different faces (501-504).

Figure 7:
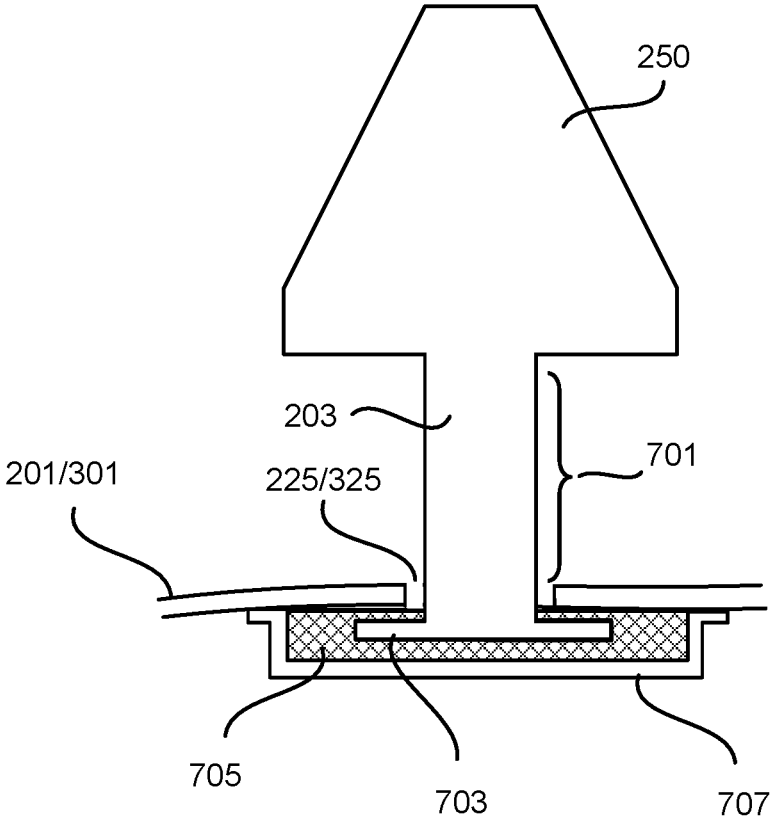
FIG. 7 illustrates a cross-sectional view of the multisided guide and reference unit and coupling and supporting member mounted to the hand wearable visual training aid device, in accordance with an embodiment.

FIG. 7 illustrates a cross-sectional view of the multisided guide and reference unit 250 and coupling and supporting member 203 mounted to the hand wearable visual training aid device (200 or 300), in accordance with an embodiment. Members of the coupling and supporting member 203 may include a support bar 701 mounted to a flange 703 (e.g., a thin support base). The coupling and supporting member 203 may be mounted to the hand wearable visual training aid device by inserting the support bar 701 through the hole (225 or 325) of the glove or strap (201 or 301, respectively) of the hand wearable visual training aid device (200 or 300, respectively). A circular patch 707 for securing the flange 703 to the glove or strap (201 or 301, respectively) may be slightly larger and generally has the same shape as the flange 703, and may be fastened to the back side of the glove or strap (201 or 301) using threading and stitching, adhesives (glue), staples or other fastening techniques. The circular patch 707 is generally made from the same material as the glove or strap (201 or 301) and conforms to the body of the hand wearable visual training aid device (200 or 300, respectively). An optional cushion or padding 705 may be applied between the bottom of the flange 703 and the circular patch 707 to provide comfort when worn by the golfer. The optional cushion or padding 705 may be made from materials such as rubber, neoprene, foam, wool, feathers, polyester fiber, non-woven material, or even soft paper. In practice, the dimensions of the support bar 701 may be approximately 2.5 inches to 4 inches in length with a radius of ¼ inch to ½ inch. The dimensions of the flange 703 may be approximately ⅛ inch to ½ inch thick with a radius of approximately ½ inch to 1 inch. In another implementation, the support bar 701 may include cylindrical tubes, rods or other bar structures such as, for example, square tubing and rectangular tubing.

Figure 8A:
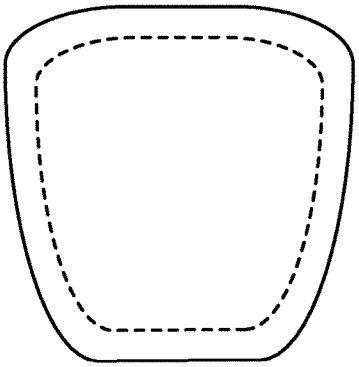
FIG. 8A-FIG. 8D illustrate several types of back hand support pads that may be applied to the surface of the strap type hand wearable visual training aid device, in accordance with an embodiment.
Figure 8B:
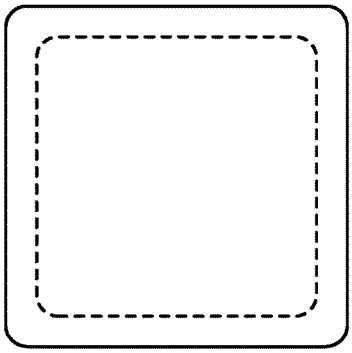
Figure 8C:
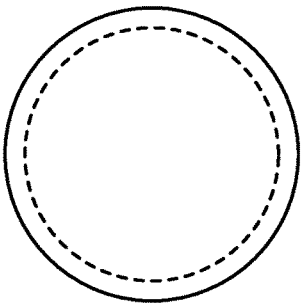
Figure 8D:
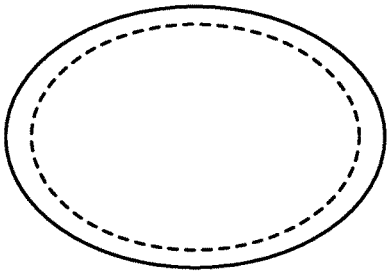

FIG. 8A-FIG. 8D illustrate several types of back hand support pads that may be applied to the surface of the strap type hand wearable visual training aid device 300, in accordance with an embodiment. FIG. 8A illustrates a rounded and tapered shaped back hand support pad 305 as presented in the previous embodiments. In other examples, the back hand support pads may be curved and rectangular in shape as shown in FIG. 8B, circular in shape as shown in FIG. 8C, and oval in shape as shown in FIG. 8D. In other embodiments, the back hand support pad may include any other variety of shapes that are able to fit within the size of the hand of the golfer 100.

Figure 9:
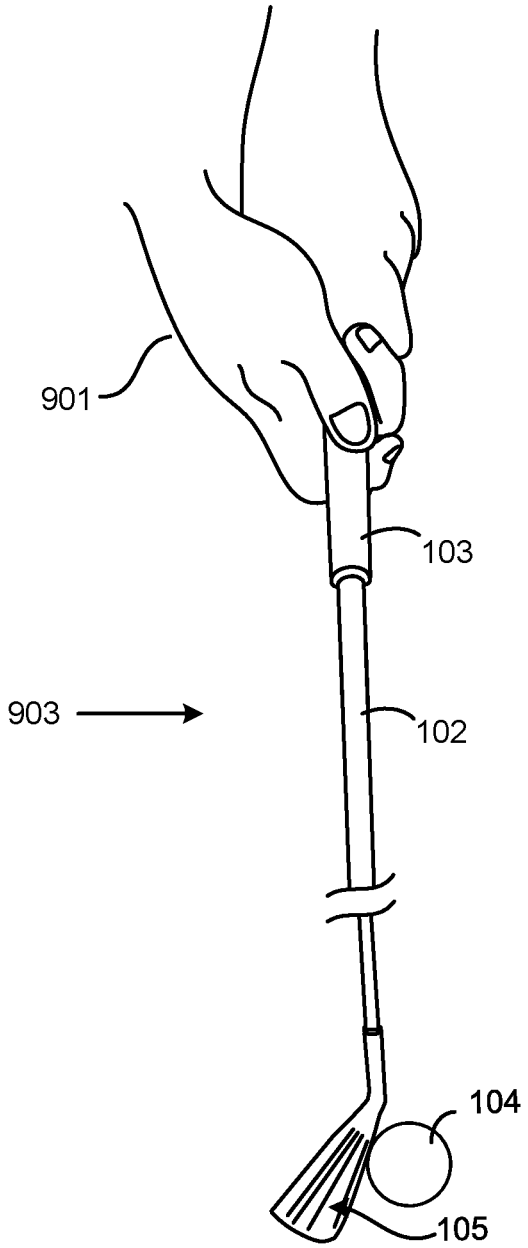
FIG. 9 illustrates a strong grip type of the golfer.
Figure 10:
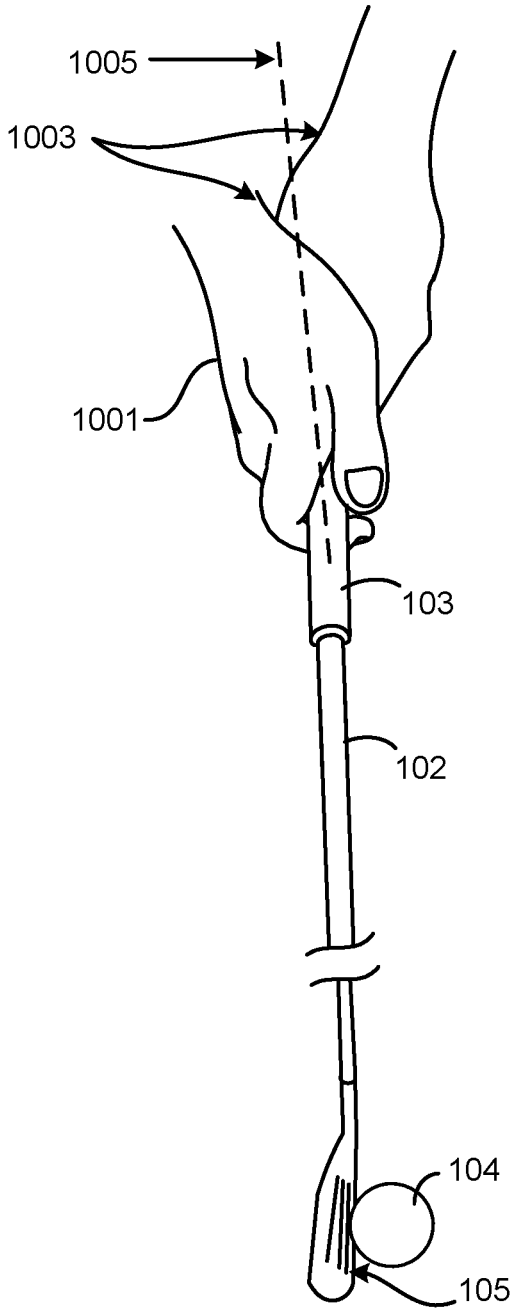
FIG. 10 illustrates a neutral grip type of the golfer.
Figure 11:
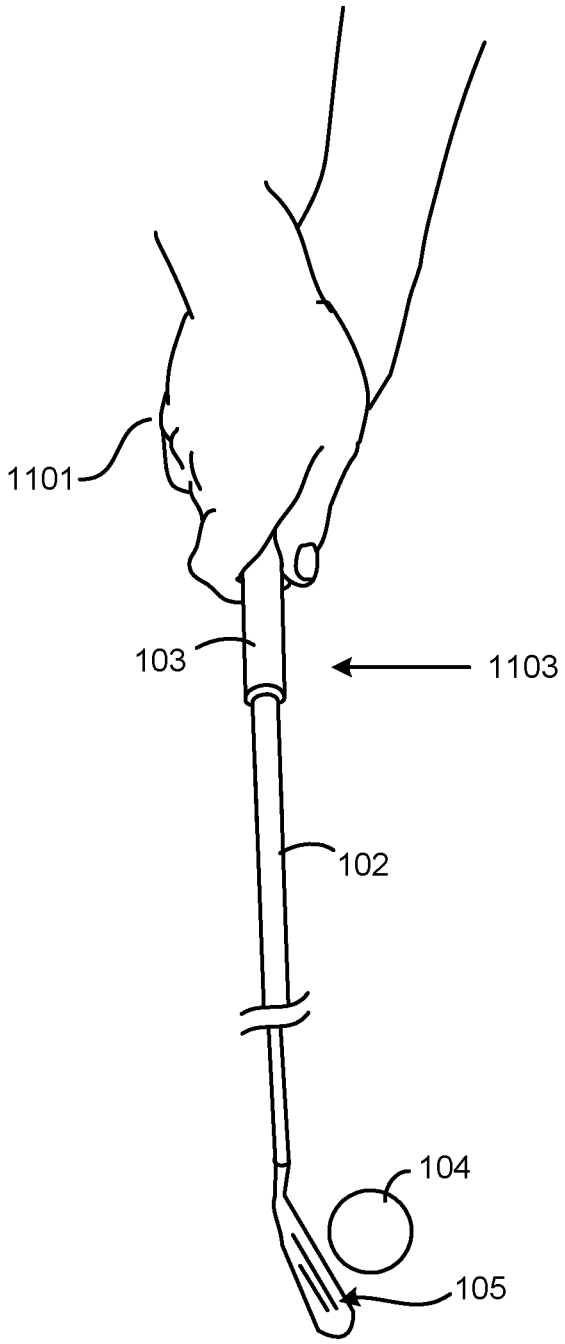
FIG. 11 illustrates a weak grip type of the golfer.

FIG. 9-FIG. 11 illustrate 3 typical grip types used by golfers which include a strong grip (FIG. 9), a neutral grip (FIG. 10), and a weak grip (FIG. 11). Though grip types may often play a significant role in improving the accuracy of the golfer, there is not a single proper grip type that is generally preferred among golfers. In FIG. 9, for example, the strong grip is generally characterized as a grip position on the club 102 where both hands 901 are rotated towards a trailing side 903 of the golfer 100. Advantages and benefits of the strong grip may include 1) maintaining clubface control and 2) providing a closed face to the target line. In FIG. 10, the neutral grip is shown with the hands 1001 and wrists 1003 in a balanced position 1005, centered to the golf club 102 and clubface 105. Benefits of the neutral grip may include 1) no added compensation to for maintaining clubface control and 2) wrist angles and clubface angle are in parallel. In FIG. 11, the weak grip is characterized as a grip position on the golf club 102 where both hands 1101 are rotated towards a leading side 1103 of the golfer. Benefits of the weak grip may include 1) producing a natural fade swing, and 2) decreasing inappropriate habits to pull or hook the ball. Selecting the best way to grip the golf club may be important to improving both accuracy and consistency. Deciding which grip is best for the golfer (strong, neutral, or weak grip) generally requires some effort on the practice range. Thus, a hand wearable visual training aid device that provides a visual feedback to the various grip types may offer the golfer a tool for practicing and perfecting a particular grip type.

Figure 12:
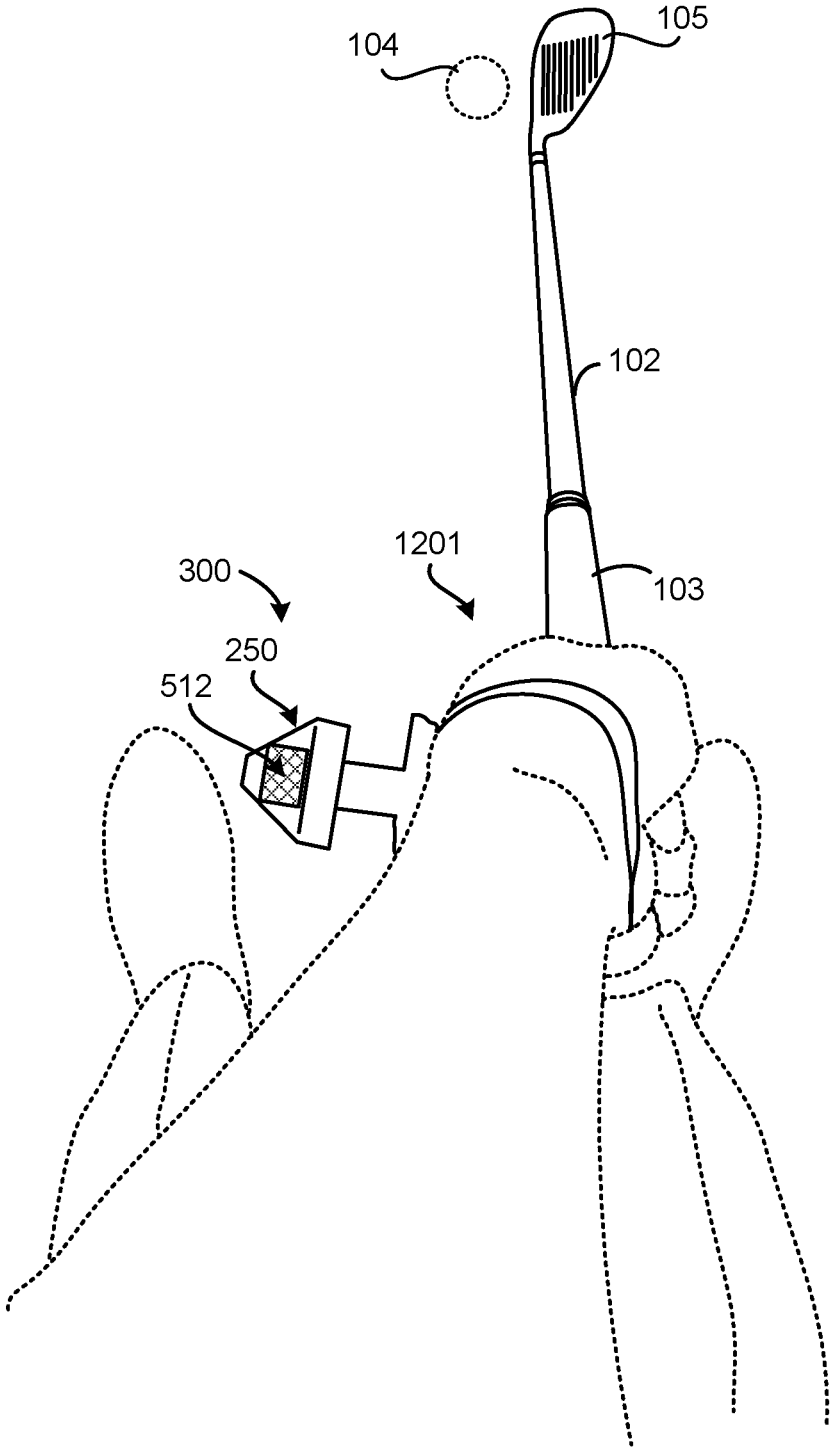
FIG. 12 illustrates a top view of the strap type hand wearable visual training aid device worn by the golfer, the multisided guide and reference unit indicating the weak grip at address position, in accordance with an embodiment.

FIG. 12 illustrates a top view of the strap type hand wearable visual training aid device 300 worn by the golfer 100, the multisided guide and reference unit 250 indicating the weak grip at address position. For demonstration purposes only, the hand 1201 on which the strap type hand wearable visual training aid device 300 is worn is shown, excluding the other hand. For the weak grip at address, the strap type hand wearable visual training aid device 300 is in the line of site of the golfer 100, providing the golfer 100 a visual feedback only one of the reference marker labels 512.

Figure 13:
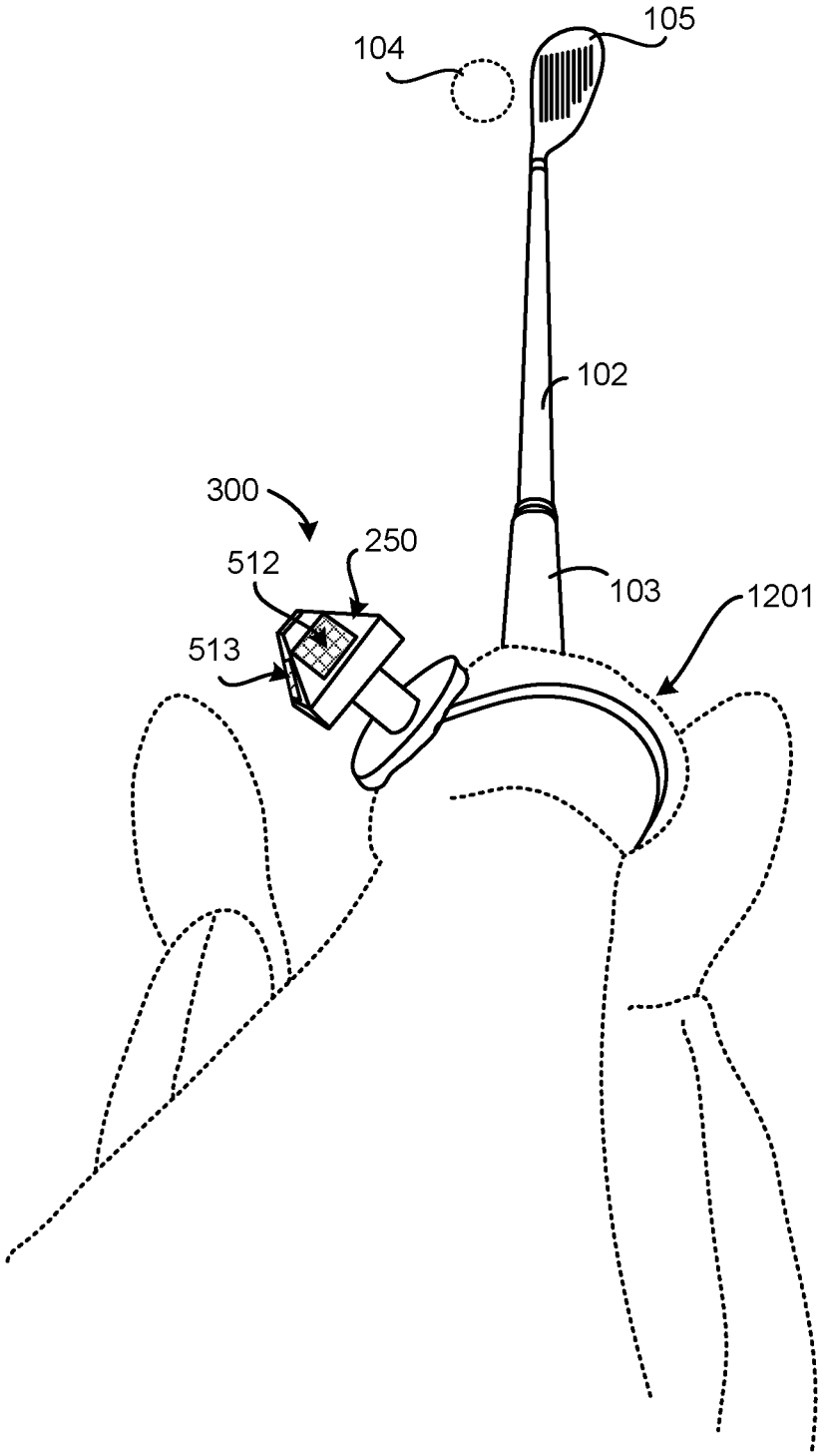
FIG. 13 illustrates a top view of the strap type hand wearable visual training aid device worn by the golfer, the multisided guide and reference unit indicating the neutral grip at address position, in accordance with an embodiment.

FIG. 13 illustrates a top view of the strap type hand wearable visual training aid device 300 worn by the golfer 100, the multisided guide and reference unit 250 indicating the neutral grip at address position. For illustrations purposes only, the hand 1201 on which the strap type hand wearable visual training aid device 300 in worn is shown, excluding the other hand. For the neutral grip at address, the strap type hand wearable visual training aid device 300 is in the line of site of the golfer 100, providing the golfer 100 a visual feedback of two reference marker labels (512, 513).

Figure 14:
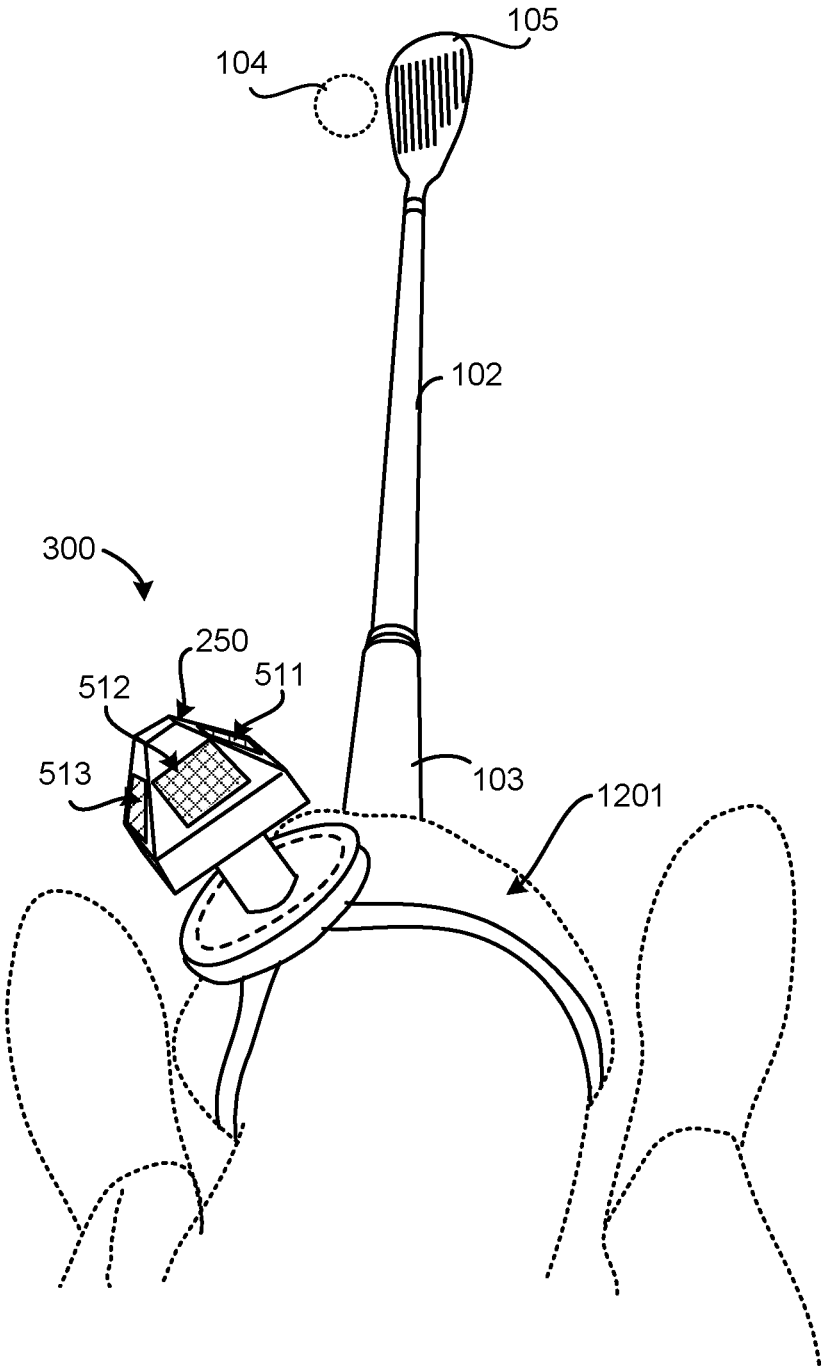
FIG. 14 illustrates a top view of the strap type hand wearable visual training aid device worn by the golfer, the multisided guide and reference unit indicating the strong grip at address position, in accordance with an embodiment.

FIG. 14 illustrates a top view of the strap type hand wearable visual training aid device 300 worn by the golfer 100, the multisided guide and reference unit 250 indicating the strong grip at address position. For illustrations purposes only, the hand 1201 on which the strap type hand wearable visual training aid device 300 in worn is shown, excluding the other hand. For the strong grip at address, the strap type hand wearable visual training aid device 300 is in the line of site of the golfer 100, providing the golfer 100 a visual feedback of three reference marker labels (511, 512, and 513).

Figure 15:
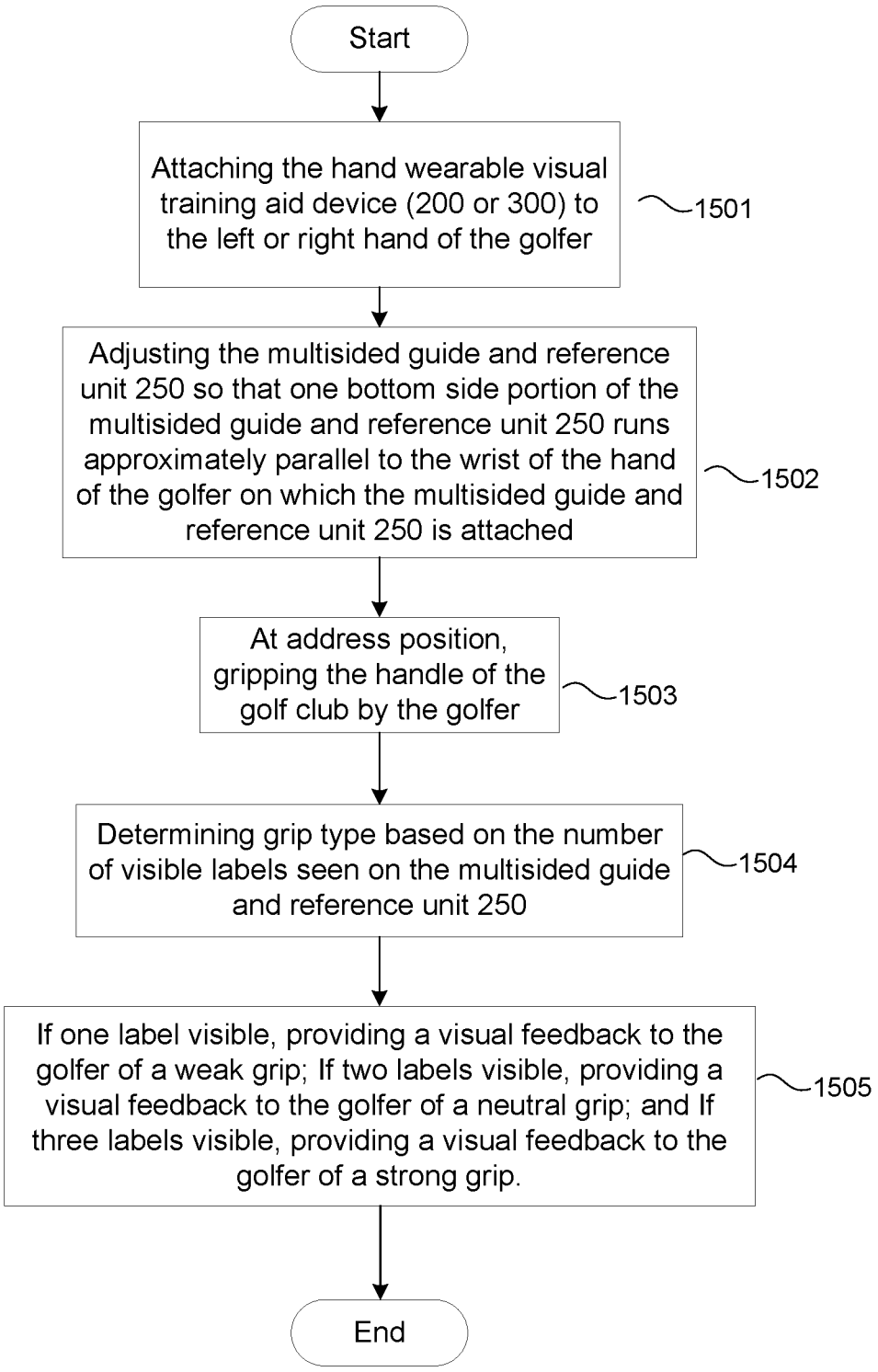
FIG. 15 illustrates a flowchart and steps of determining a grip type of a golfer using the multisided guide and reference unit of the hand wearable visual training aid device by the golfer, in accordance with an embodiment.

FIG. 15 illustrates a flowchart and steps of determining a grip type of a golfer using the multisided guide and reference unit 250 of the hand wearable visual training aid device (200 or 300) by the golfer 100, according to an embodiment. These steps include, for example, 1501) attaching the hand wearable visual training aid device (200 or 300) to the left or right hand of the golfer 100; 1502) adjusting the multisided guide and reference unit 250 so that one bottom side portion of the multisided guide and reference unit 250 runs approximately parallel to the wrist of the hand of the golfer on which the multisided guide and reference unit 250 is attached; 1503) at address position, gripping the handle of the golf club by the golfer 100, 1504) determining grip type based on the number of visible labels seen on the multisided guide and reference unit 250; and 1505) If one label is visible, providing a visual feedback to the golfer of a weak grip; if two labels are visible, providing a visual feedback to the golfer of a neutral grip; and if three labels are visible, providing a visual feedback to the golfer of a strong grip.

In one aspect and advantage, the hand wearable visual training aid device facilitates proper rotation of the wrist of the golfer which, in turn, promotes proper clubface alignment prior to impact, providing a better strike and center hit for achieving greater accuracy and distance on the golf ball.

In another aspect and advantage, the hand wearable visual training aid device is lightweight, adjustable and may be worn with or without golfing gloves, providing an ergonomic and comfortable fit while being worn by the golfer.

In yet another advantage, the hand wearable visual training aid device provides a visual feedback to the various grip types (strong, neutral, and weak) that may offer the golfer a novel tool for practicing and perfecting a particular grip type.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is:

1. A hand wearable visual training aid device for use with a golf club having a clubface, the hand wearable visual training aid device comprising:

a hand supporting body having a top side member and a palm side member opposite to the top side member;

a coupling and supporting member having a top end portion and a bottom end portion, wherein the bottom end portion is coupled to the top side member of the hand supporting body; and a multisided guide and reference unit coupled to the top end portion of the coupling and supporting member, wherein the multisided guide and reference unit provides a visual feedback representation of a golf grip type to guide the clubface of the golf club, wherein the multisided guide and reference unit is a multisided 3-dimensional structure having at least six faces, including a first side face, a second side face, a third side face, a fourth side face, a top face, and a bottom face, wherein a first reference marker label is applied to the first side face, a second reference marker label is applied to the second side face, and a third reference marker label is applied to the third side face.

2. The hand wearable visual training aid device of claim 1, wherein the hand supporting body is a glove or a hand strap.

3. The hand wearable visual training aid device of claim 1, wherein the multisided guide and reference unit provides the visual feedback representation to guide a hand of a golfer.

4. The hand wearable visual training aid device of claim 1, wherein the first reference marker label has a first label attribute, the second reference marker label has a second label attribute different from the first label attribute, and the third reference marker label has a third label attribute different from the first label attribute and the second label attribute.

5. The hand wearable visual training aid device of claim 4, wherein the first label attribute, the second label attribute, and the third label attribute include a plurality of different label colors, a plurality of different label shapes, a plurality of different label shadings, or a combination thereof.

6. The hand wearable visual training aid device of claim 1, wherein a fastener is attached to the bottom face of the multisided guide and reference unit.

7. The hand wearable visual training aid device of claim 1, wherein the coupling and supporting member includes a support bar and a flange coupled to a support bar.

8. The hand wearable visual training aid device of claim 1, wherein the multisided guide and reference unit is detachable from the coupling and supporting member.

9. The hand wearable visual training aid device of claim 1, wherein the multisided guide and reference unit and the coupling and supporting member form a single unitary structure.

10. A method of determining a golf grip type of a golfer using a hand wearable visual training aid device for use with a golf club having a handle and a clubface, the method comprising:

attaching the hand wearable visual training aid device to a left hand or a right hand of the golfer, wherein the hand wearable visual training aid device includes a multisided guide and reference unit having at least six faces and a bottom side portion;

adjusting the multisided guide and reference unit so that the bottom side portion of the multisided guide and reference unit runs approximately parallel to a wrist of the golfer on which the multisided guide and reference unit is attached;

gripping the handle of the golf club by the golfer at address position; and visually determining the golf grip type based on a number of labels visible on the multisided guide and reference unit, wherein a single visible label indicates a weak grip, two visible labels indicate a neutral grip, and three visible labels indicate a strong grip.

11. The method of claim 10, wherein the hand wearable visual training aid device includes a hand supporting body having a top side member and a palm side member opposite to the top side member and a coupling and supporting member having a top end portion and a bottom end portion, wherein the bottom end portion of the coupling and supporting member is coupled to the top side member of the hand supporting body and the top end portion of the coupling and supporting member is coupled to the multisided guide and reference unit.

12. The method of claim 11, wherein the hand supporting body is a glove or a hand strap.

13. The method of claim 11, wherein the coupling and supporting member includes a support bar and a flange coupled to the support bar.

14. The method of claim 11, wherein the multisided guide and reference unit is detachable from the coupling and supporting member.

15. The method of claim 11, wherein the multisided guide and reference unit and the coupling and supporting member form a single unitary structure.

16. The method of claim 10, wherein the multisided guide and reference unit includes a first side face, a second side face, a third side face, a fourth side face, a top face, and a bottom face, wherein a first reference marker label is applied to the first side face, a second reference marker label is applied to the second side face, and a third reference marker label is applied to the third side face.

17. The method of claim 16, wherein the first reference marker label has a first label attribute, the second reference marker label has a second label attribute different from the first label attribute, and the third reference marker label has a third label attribute different from the first label attribute and the second label attribute.

18. The method of claim 17, wherein the first label attribute, the second label attribute, and the third label attribute include a plurality of different label colors, a plurality of different label shapes, a plurality of different label shadings, or a combination thereof.

* * * * *